US006412123B1

(12) United States Patent
Lau

(10) Patent No.: US 6,412,123 B1
(45) Date of Patent: Jul. 2, 2002

(54) PORTABLE SPA

(75) Inventor: Vincent Wai Shun Lau, Hong Kong (HK)

(73) Assignee: Pleasure Time Products (Hong Kong) Limited (HK)

( * ) Notice: Subject to any disclaimer, the term of this patent is extended or adjusted under 35 U.S.C. 154(b) by 0 days.

(21) Appl. No.: 09/704,049

(22) Filed: Nov. 1, 2000

(51) Int. Cl.[7] ..... A47K 3/00; E04H 4/00

(52) U.S. Cl. ..... 4/541.1; 4/492; 4/507; 4/509

(58) Field of Search ..... 4/541.1, 541.3, 4/541.6, 492, 507, 541.5, 506, 509

(56) References Cited

U.S. PATENT DOCUMENTS

| | | | | | |
|---|---|---|---|---|---|
| 2,856,611 | A | * | 10/1958 | Velonis | 4/541.5 |
| 3,452,370 | A | * | 7/1969 | Jacuzzi | 4/541.3 |
| 3,596,296 | A | * | 8/1971 | Gertz | 4/509 |
| 4,233,694 | A | * | 11/1980 | Janosko et al. | 4/509 |
| 4,599,753 | A | * | 7/1986 | Goodman | 4/541.3 |
| 4,749,477 | A | * | 6/1988 | McGregor | 4/509 |
| 4,773,104 | A | * | 9/1988 | Wang | 4/492 |
| 4,801,378 | A | * | 1/1989 | Desjoyaux et al. | 4/509 |
| 4,853,987 | A | * | 8/1989 | Jaworski | 4/509 |
| 5,056,168 | A | * | 10/1991 | Mersmann | 4/541.6 |
| 5,597,288 | A | * | 1/1997 | Hatanaka | 4/492 |
| 5,930,851 | A | * | 8/1999 | Brunelle | 4/541.5 |
| 5,983,416 | A | * | 11/1999 | Idland | 4/541.1 |

FOREIGN PATENT DOCUMENTS

| | | | | | |
|---|---|---|---|---|---|
| DE | 2209507 B1 | * | 9/1973 | | 4/492 |
| DE | 2 313 326 | * | 9/1974 | | 4/492 |
| IT | 532405 B1 | * | 4/1958 | | 4/541.3 |
| JP | 6-90873 B1 | * | 4/1994 | | 4/541.3 |
| WO | WO-89/01620 B1 | * | 7/1989 | | 4/541.3 |

* cited by examiner

*Primary Examiner*—Charles R. Eloshway
(74) *Attorney, Agent, or Firm*—Raymond Sun

(57) ABSTRACT

A spa pool assembly has a pool that has an enclosing wall defining an interior. The assembly further includes a jet nozzle unit removably coupled to the enclosing wall and positioned in the interior, the jet nozzle unit housing a plumbing system and at least one jet nozzle. The assembly further includes a control unit that houses a pump that is coupled to the jet nozzle unit. Alternatively, a pump unit is removably received inside a channel provided in the wall and has a jet nozzle that is directed at the interior of the pool when the pump unit is received inside the channel. The jet nozzle unit, the control unit, the pump unit and the pool are separate modular units that can be assembled together quickly and conveniently.

7 Claims, 18 Drawing Sheets

PORTABLE SPA

BACKGROUND OF THE INVENTION

1. Field of the Invention

The present invention relates to portable pools, and in particular, to a portable spa pool that can be conveniently moved from one location to another, and which can be conveniently and quickly installed and disassembled.

2. Description of the Prior Art

Spa pools have become increasingly popular as people have come to recognize and enjoy the relaxing and healthy benefits accorded by a good invigorating soak in a spa pool or tub. Most conventional spa pools are provided in the form of a spa tub in a bathroom or a health club, or in the form of an outdoor spa. Each of these spa pools has a jet nozzle system that must be powered by a pump and its associated plumbing. Some spa pools are also provided with a heater that works in conjunction with the pump to heat the water that is re-circulated in the spa pool.

Unfortunately, in order to move a conventional spa pool to a different location, the entire spa pool and its accompanying jet nozzle system, pump, plumbing and heater must be completely dis-assembled and moved. Such dis-assembly can be quite complex, and often requires the expertise of a plumber. Even if a normal user is able to accomplish the dis-assembly on his or her own, such dis-assembly is very time-consuming and difficult, and any subsequent re-assembly will be equally time-consuming and challenging. In other words, conventional spa pools tend to stay fixed in their original locations, and are unlikely to be moved to a different location.

Such lack of portability is a significant drawback, since nowadays people are more mobile and often enjoy travelling and moving about. It would be desirable if they could also enjoy the luxury and benefit of the spa pool at different locales while not experiencing the inconveniences and difficulties associated with having to assemble and dis-assemble a conventional spa pool. This would encourage and promote increased use of spa pools.

Another drawback associated with conventional spa pools is that the plumbing systems are typically provided outside the pool. Unfortunately, conventional plumbing systems are quite susceptible to leaks (e.g., at the hose connections with the jet nozzles), which makes it less desirable to use such conventional spa pools inside the house.

Thus, there remains a need for a portable spa pool that overcomes the problems associated with the conventional spa pools, which minimizes leaks, which can be installed and disassembled for storage in a quick and convenient manner, and which can be packed and moved about conveniently.

SUMMARY OF THE DISCLOSURE

It is an objective of the present invention to provide a portable spa pool which can be installed and disassembled for storage in a quick and convenient manner, and which can be packed and moved about conveniently.

It is another objective of the present invention to provide a portable spa pool which minimizes leakage of water that is contained inside the spa pool.

It is yet another objective of the present invention to provide a portable spa pool which has a modular design.

The objectives of the present invention are accomplished by providing a spa pool assembly having a pool that has an enclosing wall defining an interior. The assembly further includes a jet nozzle unit removably coupled to the enclosing wall and positioned in the interior, the jet nozzle unit housing a plumbing system and at least one jet nozzle. The assembly further includes a control unit that houses a pump that is coupled to the jet nozzle unit. The jet nozzle unit, the control unit, and the pool are separate modular units that can be assembled together quickly and conveniently. In addition, the jet nozzle unit contains a minimal number of water inlets and water outlets to minimize the possiblity of leakage.

According to another embodiment of the present invention, a spa pool assembly has a pool having an enclosing wall defining an interior, the wall further including a channel provided therein, with the channel in fluid communication with the interior. The assembly further includes a pump unit removably received inside the channel, the pump unit including a jet nozzle that is directed at the interior of the pool when the pump unit is received inside the channel. The pump unit and the pool are separate modular units that can be assembled together quickly and conveniently.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

The present invention provides a spa pool that can be easily and quickly assembled and dis-assembled without the need for any special tools. The spa pool of the present invention provides a plumbing system that is completely housed in a separate and removable housing or unit that can be easily and conveniently coupled to the pool, thereby virtually eliminating the potential for water leakage from inside the pool that may be caused by the plumbing system. The potential for water leakage is further minimized by providing the plumbing system and its housing primarily inside the spa pool, and with a minimal number of water inlet and water outlet connections emanating from the plumbing system and its housing. Other benefits and features will be described in connection with the spa pool hereinbelow.

Referring to FIGS. 1–4, the present invention provides, in one embodiment, a portable spa pool assembly 20 that has a pool 22, a jet nozzle unit 24, and a control unit 26. As described in greater detail hereinbelow, the jet nozzle unit 24 has a housing that contains the plumbing system and jet nozzles, and which is a separate housing that can be removably coupled to the pool 22. The control unit 26 has a casing that contains the pump, motor and air switch that are used to control the operation of the jet nozzles, and is coupled to the jet nozzle unit 24 via two hoses that deliver water to, and receive water from, the jet nozzle unit 24. The pool 22, the jet nozzle unit 24 and the control unit 26 are each separate from each other and can be modular units that are replaceable or changeable without the need to replace or change the other units.

Figure 1:
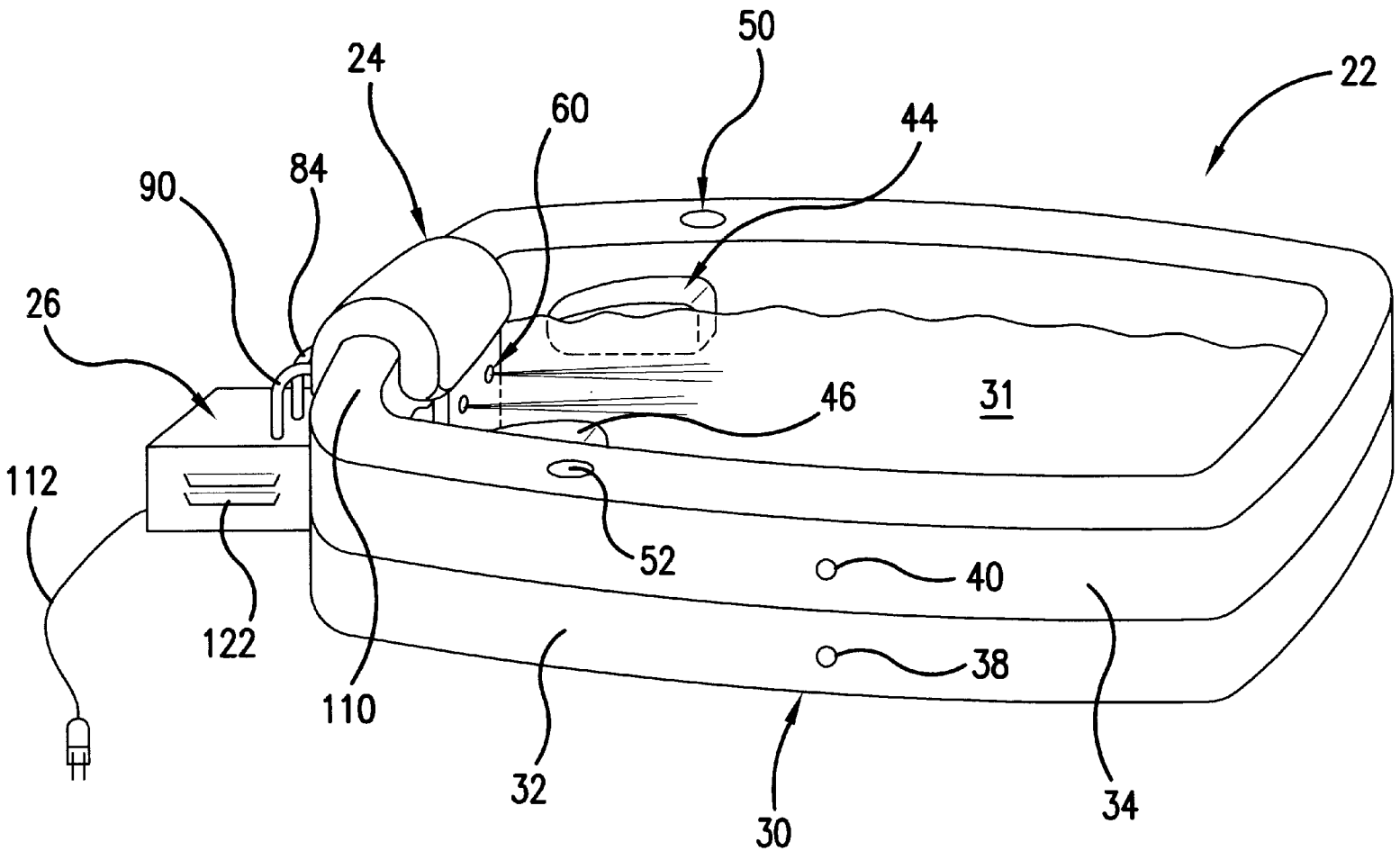
FIG. 1 is a perspective view of a portable spa pool according to one embodiment of the present invention.
Figure 2:
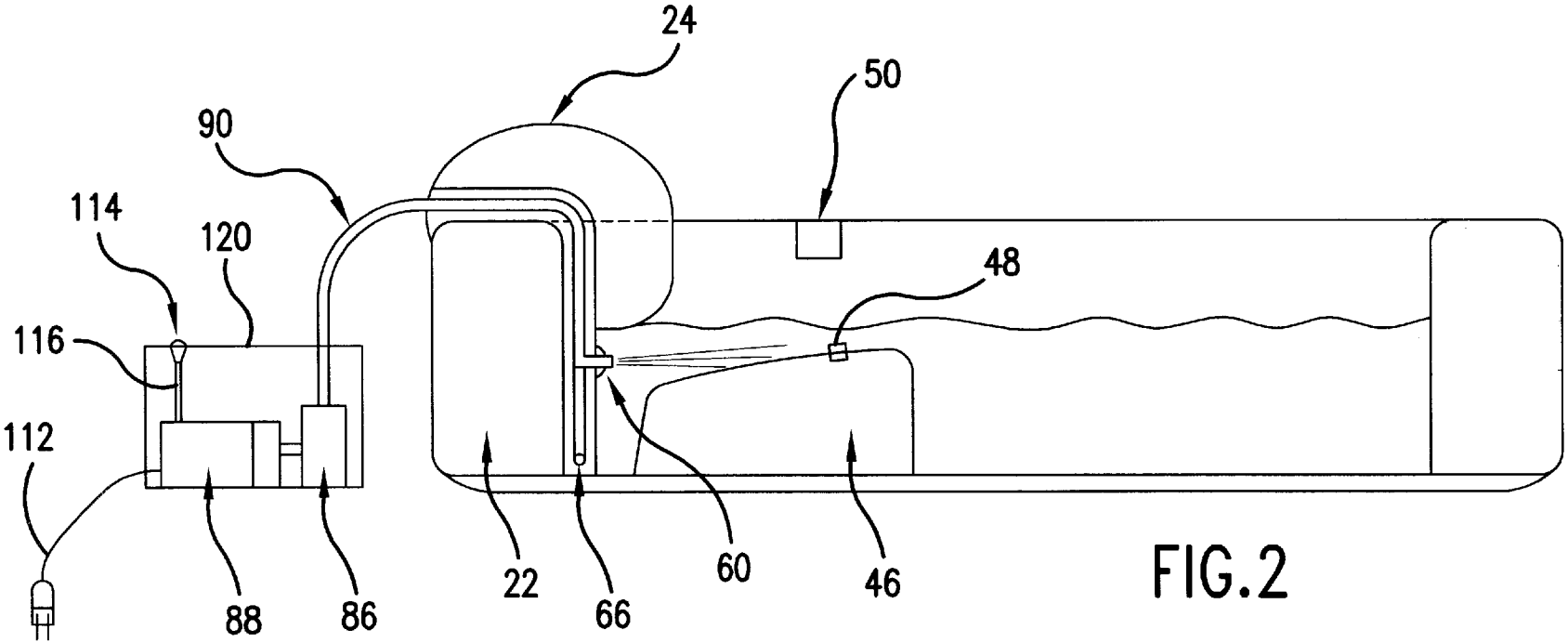
FIG. 2 is a cross-sectional side view of the spa pool of FIG. 1.
Figure 3:
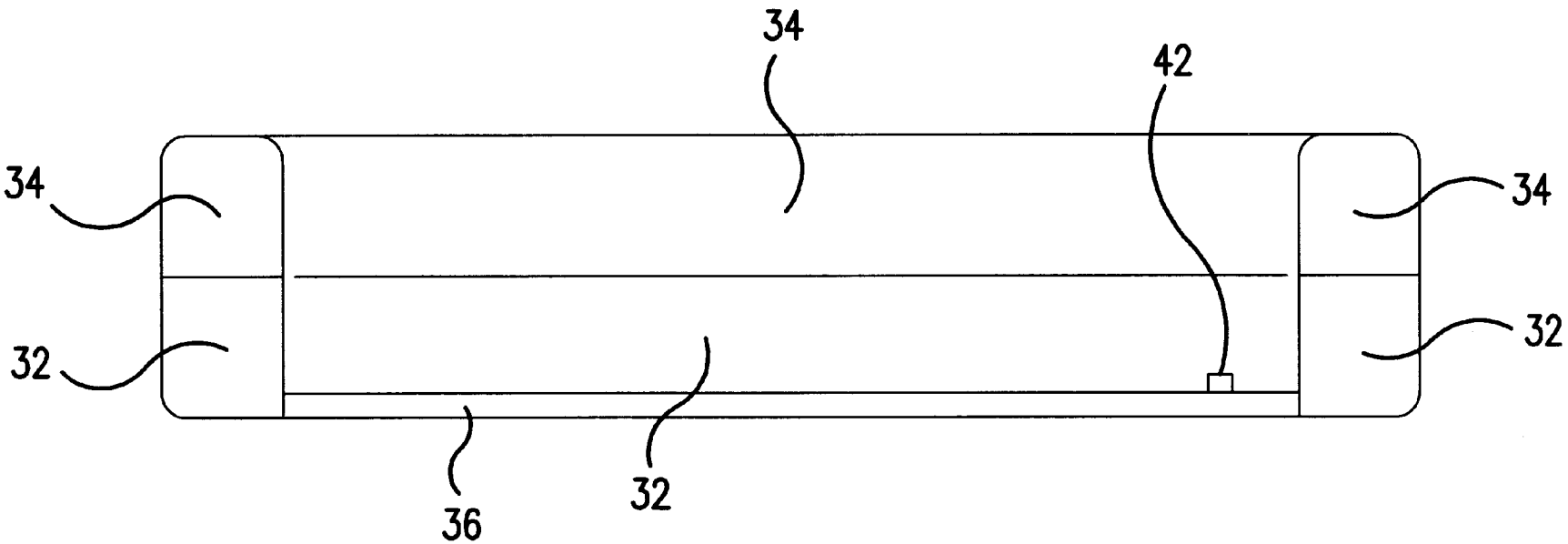
FIG. 3 is a cross-sectional side view of the pool of the spa pool of FIG. 1.

Referring now to FIGS. 1–3, the pool 22 has an enclosing side wall 30 that defines the interior 31 of the pool 22. The side wall 30 has three separate sections, a first or lower surrounding inflatable air chamber 32, a second or upper surrounding inflatable air chamber 34, and a third or floor chamber 36 that functions as the floor or bottom of the pool 22. The air chambers 32, 34 and 36 are inflatable to define the shape of the pool 22 when fully inflated, and can be made from a material that is water-impervious and which is capable of tolerating heat and cold. Non-limiting examples of the material can include PVC, rubber, nylon, PU lamination, and polyethylene. The material also acts as a water-containing layer of material that protects against water leakage, and to protect the pool 22 itself from puncture or other damage. Cold-crack additives (i.e., cold weather proofing) and other additives can be coated or added to the surface of the material to improve the durability of the material. In one embodiment of the present invention, the air chambers 32, 34 and 36 are made of a heat and chlorine resistant polyvinylchloride (PVC) material. In one embodiment, the pool 22 can be manufactured by heat sealing the three chambers 32, 34, 36. The air chambers 32, 34, 36 have valves 38, 40, 42, respectively, through which air can be introduced to inflate the chambers 32, 34, 36.

The pool 22 further includes two additional chambers 44 and 46 that can be inflated to function as arm rests. These arm rests 44 and 46 can be formed from the same material as the chambers 32, 34, 36 and extend from the floor chamber 36, and each has a valve (e.g., see 48 in FIG. 2) through which air can be introduced to inflate the arm rests 44 and 46. In addition, two cup holder slots 50 and 52 can be provided in the upper chamber 34 for holding cups.

The pool 22 need not be inflatable. For example, it is also possible to provide the pool 22, its wall 30, its floor 36, and its arm rests 44, 46 in a solid piece of foam or other solid material that is molded to the configuration shown in FIGS. 1–3.

Figure 6:
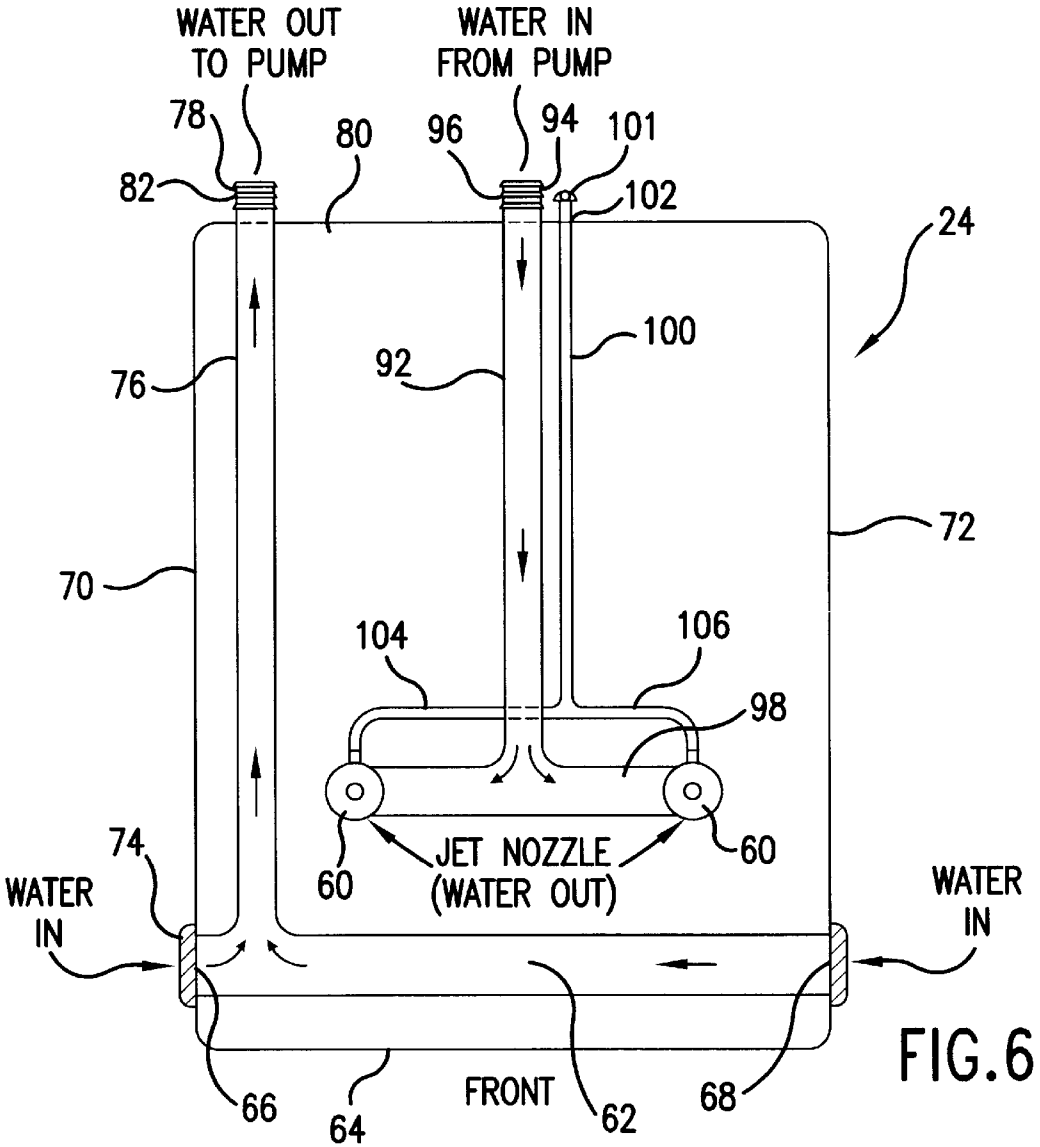
FIG. 6 is a cross-sectional front plan view of the plumbing system of the jet nozzle unit of FIGS. 2 and 4.
Figure 5:
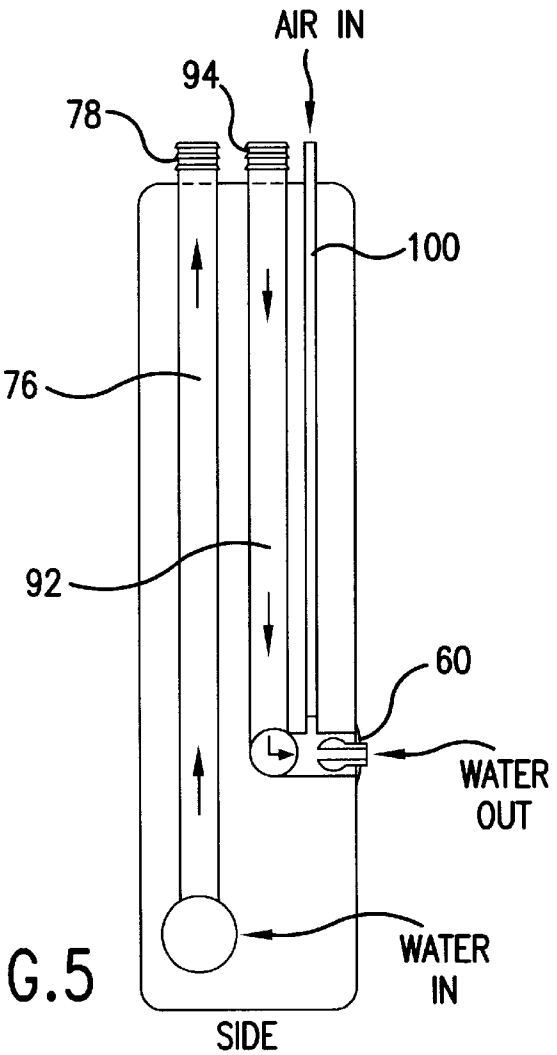
FIG. 5 is a cross-sectional side plan view of the plumbing system of the jet nozzle unit of FIGS. 2 and 4.
Figure 8:
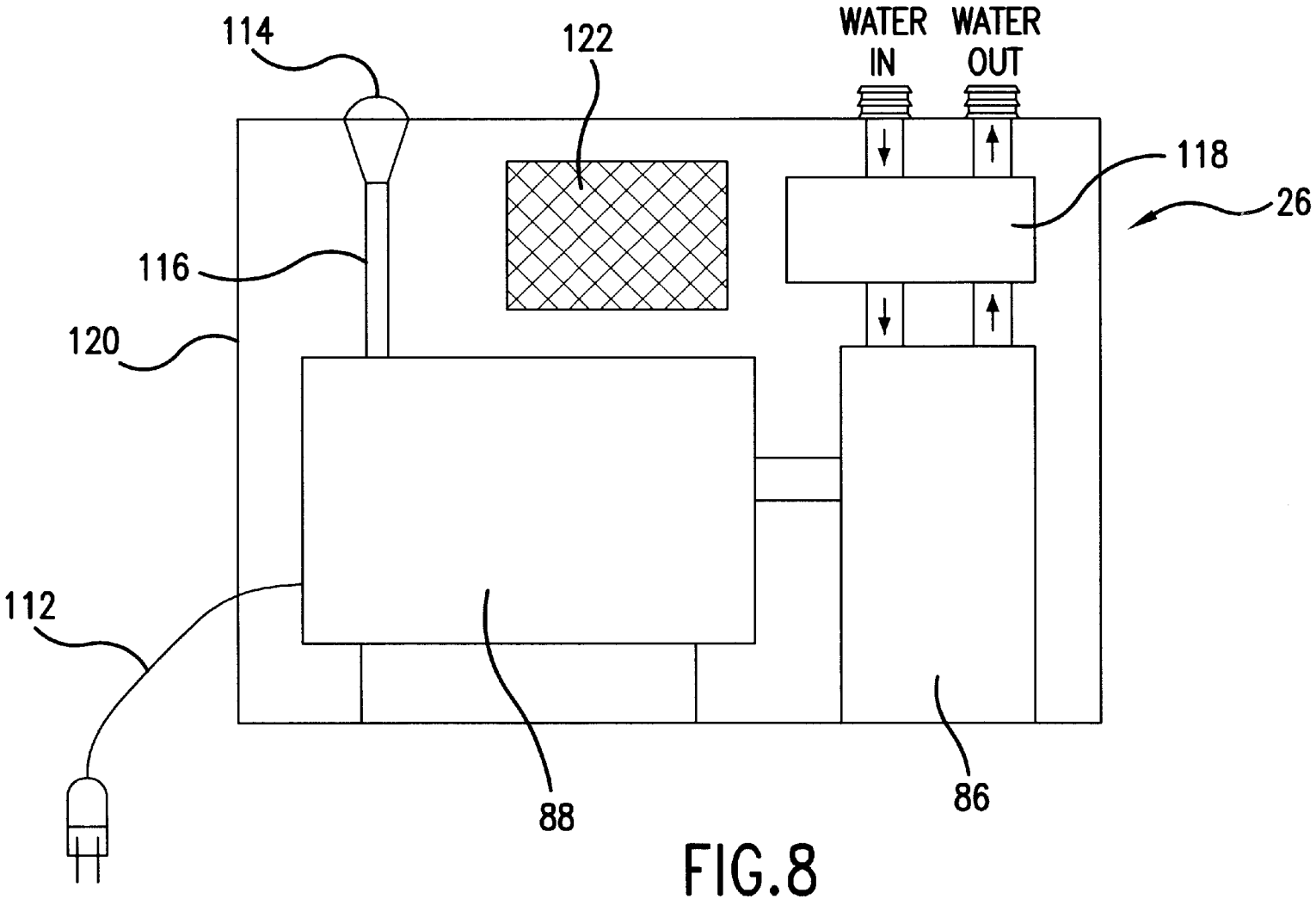
FIG. 8 illustrates a control unit according to one embodiment of the present invention.

The plumbing system is illustrated in greater detail in FIGS. 2, 5 and 6. The plumbing system includes a plurality of jet nozzles 60, and a plurality of air hoses, water hoses and tubing that interconnect the jet nozzles 60 in the manner illustrated in FIGS. 2, 5 and 6. The jet nozzle unit 24 houses the tubings, jet nozzles 60, and air hoses. A bottom tubing 62 is provided adjacent the bottom 64 of the jet nozzle unit 24, and has opposing ends that are positioned at openings 66 and 68 in the side walls 70 and 72, respectively, of the jet nozzle unit 24. These opposing ends of the bottom tubing 24 function as water inlets through which water from the interior 31 of the pool 22 can be drawn. A strainer 74 can be positioned in front of each opening 66, 68 to collect or filter debris and other particles to prevent these particles from being transported to the plumbing system.

The bottom tubing 62 is fluidly coupled to a vertical intake tubing 76 that terminates at a water outlet 78 at the top 80 of the jet nozzle unit 24. A portion of the vertical intake tubing 76 extends beyond the top of the jet nozzle unit 24 and has threads 82 provided thereon for engaging an end of an intake hose 84. The opposing end of the intake hose 84 extends into the casing of the control unit 26 and is coupled to a pump 86 in the control unit 26, so that the pump 86 can operate to draw the water from the interior 31 of the pool 22 through the openings 66, 68 and into the pump 86 via the tubings 62 and 76, and the intake hose 84. A motor 88 is coupled to the pump 86 to drive the pump 86.

An output hose 90 has one end coupled to the pump 86, and extends from the casing of the control unit 26. A vertical output tubing 92 is provided inside the jet nozzle unit 24 and terminates at a water inlet 94 at the top 80 of the jet nozzle unit 24. A portion of the vertical output tubing 92 extends beyond the top of the jet nozzle unit 24 and has threads 96 provided thereon for engaging an end of the output hose 90. A generally horizontal delivery tubing 98 is fluidly coupled to the vertical output tubing 92. The jet nozzles 60 are provided along the delivery tubing 98, as illustrated in greater detail in FIG. 7 below. Thus, the pump 86 delivers the water via the output hose 90 and the vertical output tubing 92 to the delivery tubing 98 where the water can be ejected from the nozzles 60.

Figure 7:
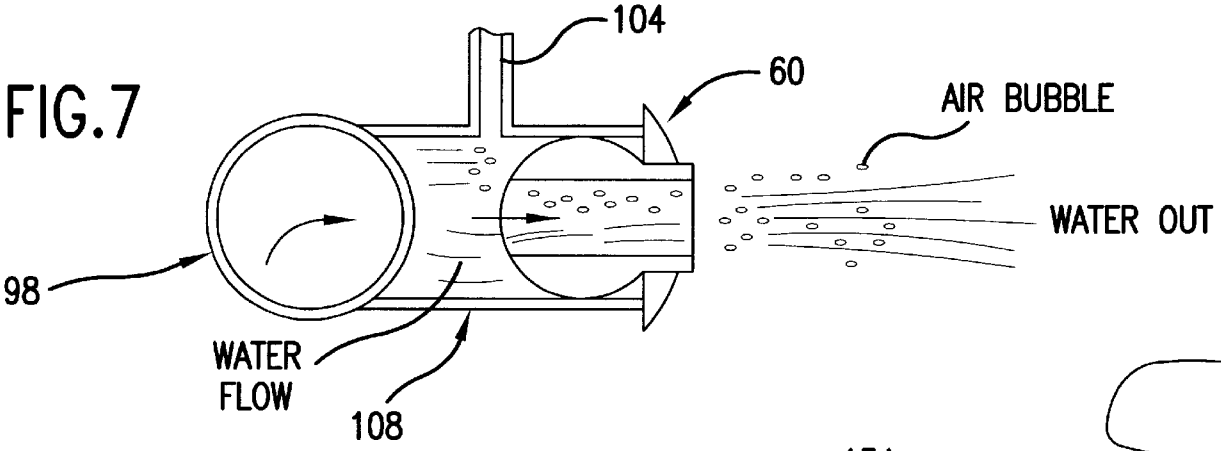
FIG. 7 is a cross-sectional view of one jet nozzle of the jet nozzle unit of FIGS. 2 and 4.

An air hose 100 extends via an air opening 102 at the top 80 of the jet nozzle unit 24 into the interior of the jet nozzle unit 24. The air hose 100 is coupled to an air control 101. The air hose 100 is open to the environment and the air control 101 can be optional. The air hose 100 branches into two separate branches 104 and 106, each of which directs the air to a separate nozzle 60. Referring to FIG. 7, each nozzle 60 is housed in a nozzle housing 108. Each jet nozzle 60 can be any conventional jet nozzle that is currently available and used for conventional spa pools. For example, two types of jet nozzles 60 can be used: a water flow adjustable nozzle and a non-adjustable nozzle. The jet nozzles 60 can also be one-directional, or multi-directional that are adjustable by the user to massage different areas of the user's back. The corresponding branch 104 or 106 of the air hose 100 is coupled to the nozzle housing 108 so that the air delivered by the air hose 100 can mix with the water being delivered by the delivery tubing 98 before being ejected from the nozzle 60.

Figure 4:
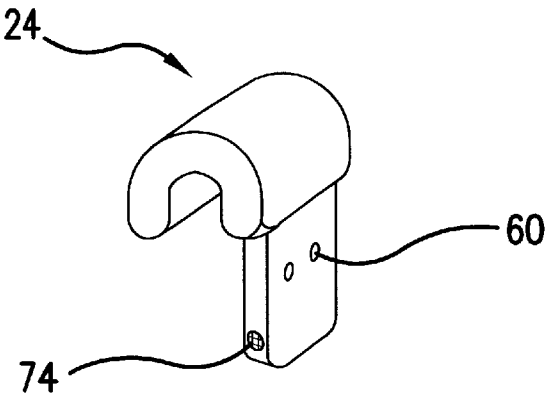
FIG. 4 is a perspective view of the jet nozzle unit of the spa pool of FIG. 1.

Although FIGS. 1, 4 and 6 illustrate that two nozzles 60 are provided, it is also possible to provide any number of nozzles 60 along the delivery tubing 98, and any other delivery tubings that can be provided to branch off the vertical output tubing 92. Where additional nozzles 60 are provided, additional branches of the air hose 100 will also need to be provided to extend into the corresponding nozzle housings 108.

Each hose 84, 90 can be made from the same material, such as PVC, and can have weaved nylon reinforcements laminated into the hose itself. The tubings 62, 76, 92 and 98 can be provided in the form of pipes that are made of hard PVC, metal or other hard materials. The hoses 84, 90 and the tubings 62, 76, 92 and 98 should preferably be able to withstand high water pressure and heat. The air hose 100 and its branches 104, 106 can be made from standard PVC hoses.

The jet nozzle unit 24 is preferably made from a strong yet flexible material, such as PVC or foam. The jet nozzle unit 24 houses the tubings 62, 76, 92 and 98, the air hose 100 and its branches 104, 106, and the nozzles 60, and so requires a strong material to protect these components. For example, if foam is used, the foam material would provide the structural integrity to hold the components in place. In addition, the jet nozzle unit 24 is preferably made from a flexible material so that it can be positioned or draped over a side wall (e.g., end wall 110) of the pool 22 in a manner so that the nozzles 60 extend into the interior of the pool 22. This allows the user to sit inside the pool 22 with his or her back resting against or adjacent the nozzles 60. The material should also provide a comfortable back rest for the user.

The jet nozzle unit 24 can be designed to withstand 200 pounds compression pressure, just in case someone sits or stands on the unit 24.

The control unit 26 has a plastic or metal casing 120 which houses the pump 86 and the motor 88. The motor 88 can be a direct current (DC) or alternating current (AC) motor. A power cord 112 extends from the motor 88 through the casing 120 to the exterior. The motor 88 is equipped with a 110 volt GFCI (ground fault control interrupter) component. An air button 114 extends from outside the control unit 26 and is coupled to the motor 88 via a vacuum tube 116. The air button 114 functions to turn on the pump 86 by operating the motor 88, and is used to provide additional safety to the user because the user is not exposed to any electrical components when turning on and off the pump 86. One or more grills 122 can be provided on the casing 120 to function as a vent for allowing cool air to enter the casing 120 to cool the motor 88 and pump 86. In addition, a cooling fan (not shown) can be mounted in the casing 120 to cool the motor 88 and pump 86. In addition, a heater 118 can be provided between the hoses 84 and 90, and the pump 86. The heater 118 can be automatically activated by a water pressure sensor (built into the heater) which turns on the heater 118 when water begins to travel through it. The heater 118 can also be provided with an automatic maximum temperature cut-off if the water reaches a pre-selected maximum temperature (e.g., 104 degrees Fahrenheit). The heater 118 is optional and can be omitted. As one non-limiting example, the control unit 26 can be embodied in the form of the PS-1 System marketed by Spa Builders System Group.

To assemble the spa pool assembly 20, the pool 22 is inflated by inflating the air chambers 32, 34, 36, 44, 46. The jet nozzle unit 24 can be draped or placed over a side wall of the pool 22 with the nozzles 60 positioned inside the interior 31 of the pool 22. The jet nozzle unit 24 can be removably secured to the pool 22 using one of the techniques illustrated below. The control unit 26 can be placed on the ground outside and adjacent to the pool 22, and the water hoses 84 and 90 connected to the tubings 76 and 92, respectively. The assembly is now complete, and as shown above, can be done very quickly and conveniently.

Water can be filled into the interior 31 of the pool 22 to the required water level (preferably above the level of the nozzles 60), and the pump 86 primed by drawing water from the pool 22 into the pump 86. Once the pump 86 has been primed, the pump 86 is ready to begin recirculating water. The spa pool assembly 20 is now ready for use.

To use the spa pool assembly 20, the user plugs in the power cord 112 to a power source, and then turns on the motor 88 by actuating the air button 114. Since the pump 86 has been primed, water can be drawn through the strainers 74 and openings 66, 68 through the tubings 62 and 76, and the hose 84, into the pump 86. If the heater 118 is provided, the water would pass through the heater before reaching the pump 86. The water is then pumped via the hose 90 and the tubings 92 and 98 to each jet nozzle housing 108, where the water can be ejected from each corresponding jet nozzle 60. The water is re-circulated in the same manner described above. The heater 118 (if provided) is automatically turned on when water begins to circulate through the system.

Air bubbles can be ejected through each jet nozzle 60 due to an air pressure system. Specifically, the air control 101 is like an air inlet, and it couples the air hose 100 to the ambient. The user can control the amount of air that enters the air control 101, so as to create an air pressure that is lower than the water pressure. Air is drawn from vacuum created by the high water pressure, so the lower air pressure and higher water pressure will cause air bubbles to be generated where the air meets the water in the jet nozzle housing 108 (as shown in FIG. 7), and then delivered via the jet nozzles 60 to the interior of the pool 22.

To dis-assemble the spa pool assembly 20, the user turns off the motor 88, and disconnects all the components by reversing the steps described above. The jet nozzle unit 24 is removed from the pool 22. The air chambers 32, 34, 36, 44 and 46 are then deflated and all the components can be packed for storage or transportation. Since the plumbing system is almost completely encompassed inside the modular housing of the jet nozzle unit 24, the jet nozzle unit 24 can be stored separately from the pool 22 and the control unit 26. For example, the jet nozzle unit 24 can be stored in a pre-fabricated storage container to minimize damage to the components of the plumbing system. The provision of a plumbing system in a modular jet nozzle unit 24 minimizes the possibility of leakage from either the plumbing system or the pool 22.

In addition, it is important to note that the plumbing system (i.e., the jet nozzle unit 24 and the control unit 26) can be installed into or taken out of the pool 22 without deflating the pool 22. Coupled with the fact the pool 22 itself has no openings, the possibility of water leakage from the interior 31 of the pool 22 is significantly minimized.

The modularity of the different units 22, 24, 26 also provides several important benefits. First, the modularity allows for convenient replacement of defective units without the need to replace non-defective units. Second, the modularity increases the convenience of assembly, dis-assembly, servicing and maintenance of the spa pool assembly 20. Third, the assembly and disassembly of the spa pool assembly 20 does not require the use of special tools, thereby allowing the spa pool assembly 20 to be conveniently moved about for use in many different locations.

FIGS. 9–21 illustrate several non-limiting methods of coupling the jet nozzle unit 24 to the wall 30 of the pool 22. Each of these coupling methods allow for the removable coupling of the jet nozzle unit 24 to the wall 30.

Figure 9A:
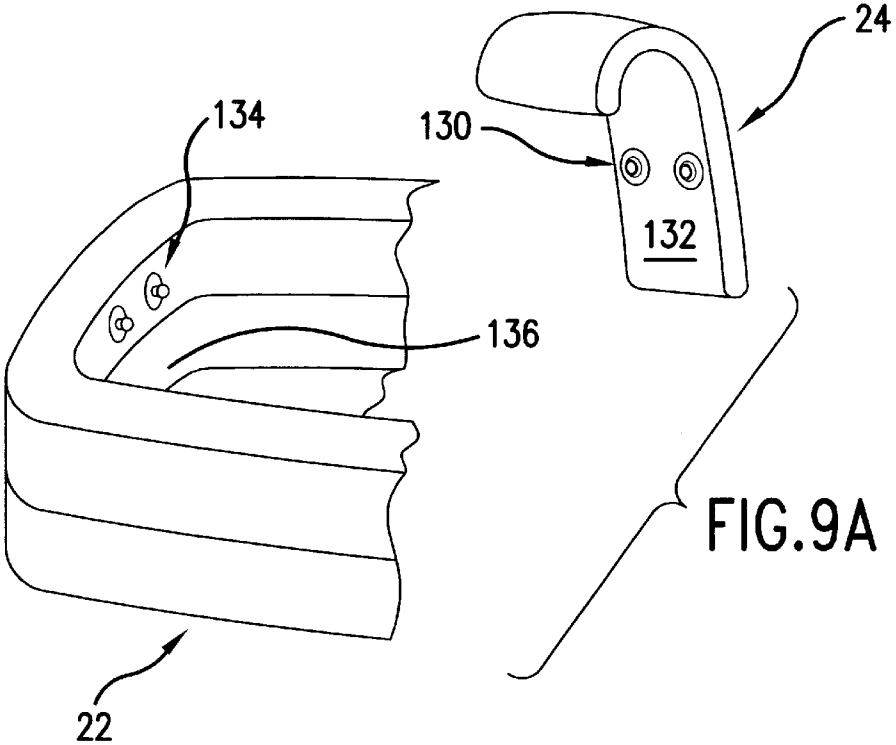
FIGS. 9–21 illustrate different methods of connecting the jet nozzle unit to a wall of the pool.
Figure 9B:
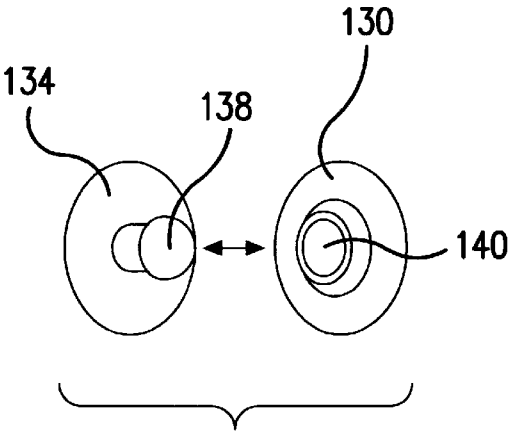

For example, as shown in FIGS. 9A and 9B, one or more female snaps 130 can be provided on the rear side 132 of the jet nozzle unit 24, and one or more corresponding male snaps 134 can be provided along an inner wall 136 of the pool 22. Each female snap 130 includes an opening 140 through which the bulbous end 138 of each corresponding male snap 134 can be inserted. The bulbous nature of the end 138 retains the male snap 134 inside the female snap 130.

Figure 11:
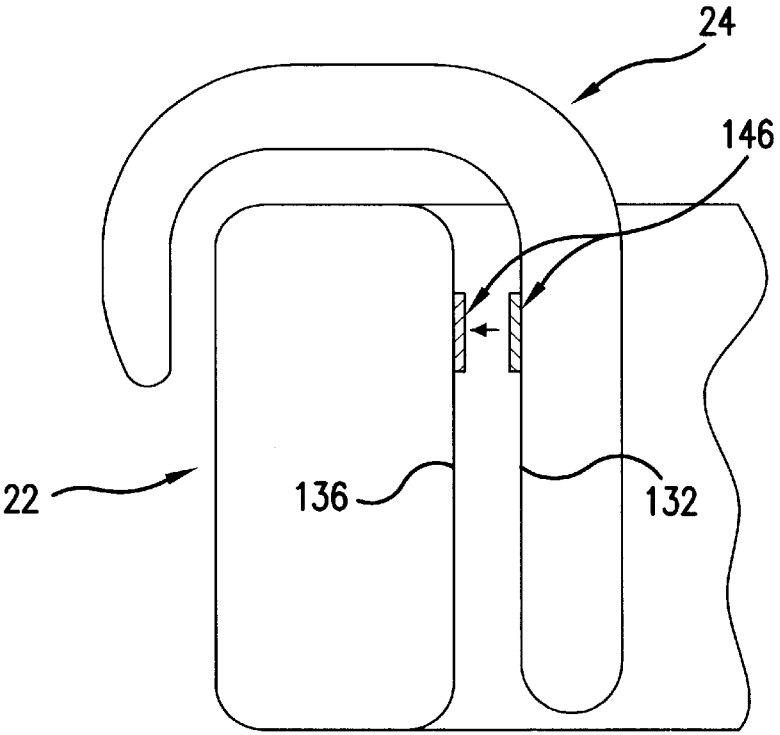
Figure 10:
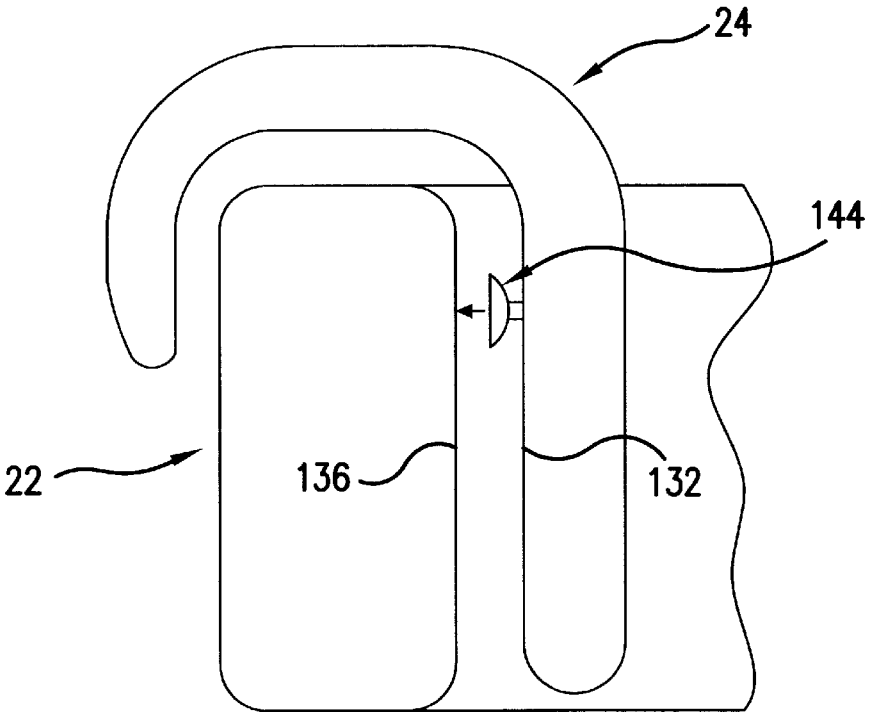
Figure 12:
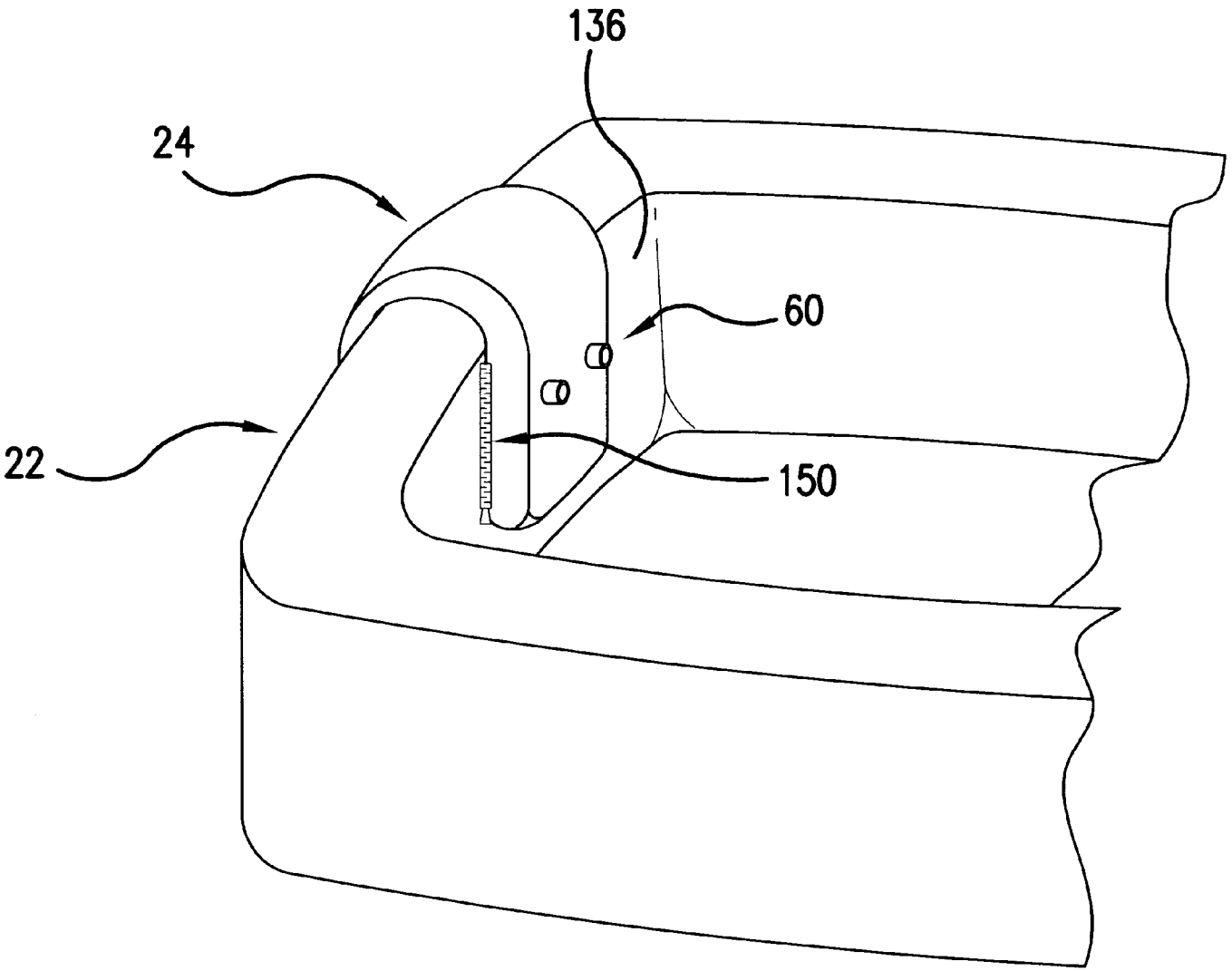

Attachment mechanisms can also be used. For example, as shown in FIG. 10, a suction cup 144 can be provided on the rear side 132 of the jet nozzle unit 24, and adapted to attach to the inner wall 136 of the pool 22. As a further example, as shown in FIG. 11, opposing VELCRO™ pads 146 can be provided on the rear side 132 of the jet nozzle unit 24 and the inner wall 136 of the pool 22 to provide a removable connection. Similar in concept to FIG. 10, a double adhesive tape (not shown) can be provided in lieu of the suction cup 144 in FIG. 10. As yet another example, FIG. 12 illustrates the use of a zipper 150 to zip or attach the jet nozzle unit 24 to the inner wall 136 of the pool 22.

Figure 13:
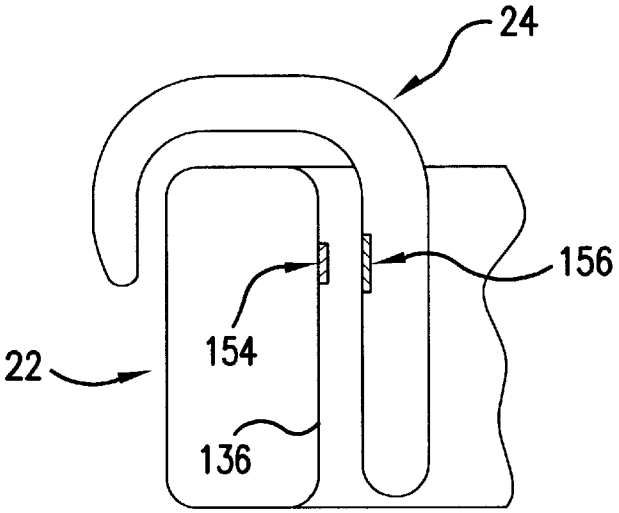

Another similar concept is shown in FIG. 13, where a magnet 154 is provided on the inner wall 136, and is adapted to attract (i.e., couple) a metal plate 156 that is provided on the inner surface of the rear side 132 of the jet nozzle unit 24.

Figure 14:
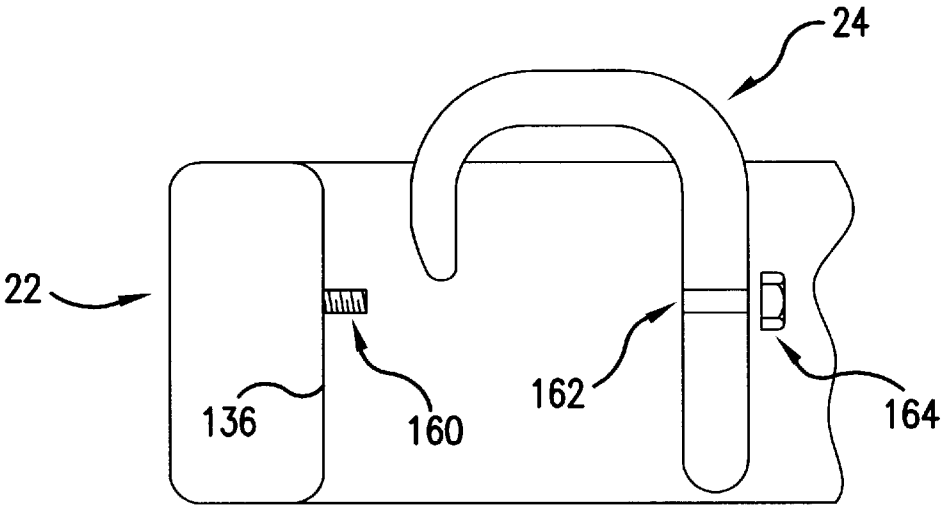
Figure 15:
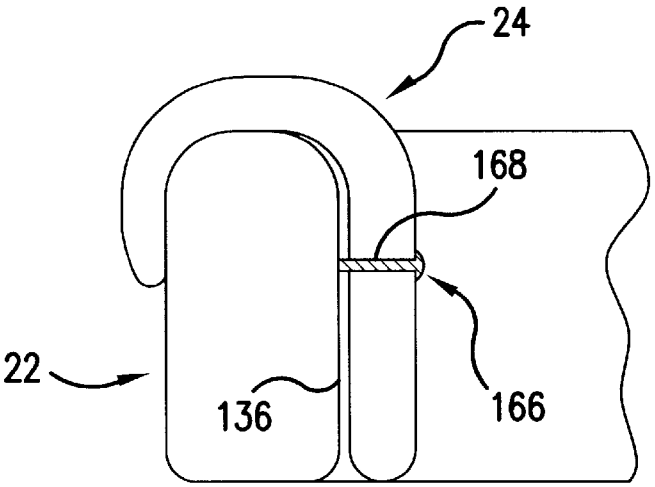

Screws and rivets can also be used. For example, FIG. 14 illustrates the use of a screw 160 provided on the inner wall 136 that is adapted to extend through an opening 162 in the jet nozzle unit 24, with a bolt 164 provided to be threadably engaged at the end of the screw 160 to secure the jet nozzle unit 24 to the inner wall 136. Similarly, FIG. 15 illustrates the use of a rivet 166 that is adapted to extend through an opening 168 in the jet nozzle unit 24 to be attached to the inner wall 136 of the pool 22.

Figure 16:
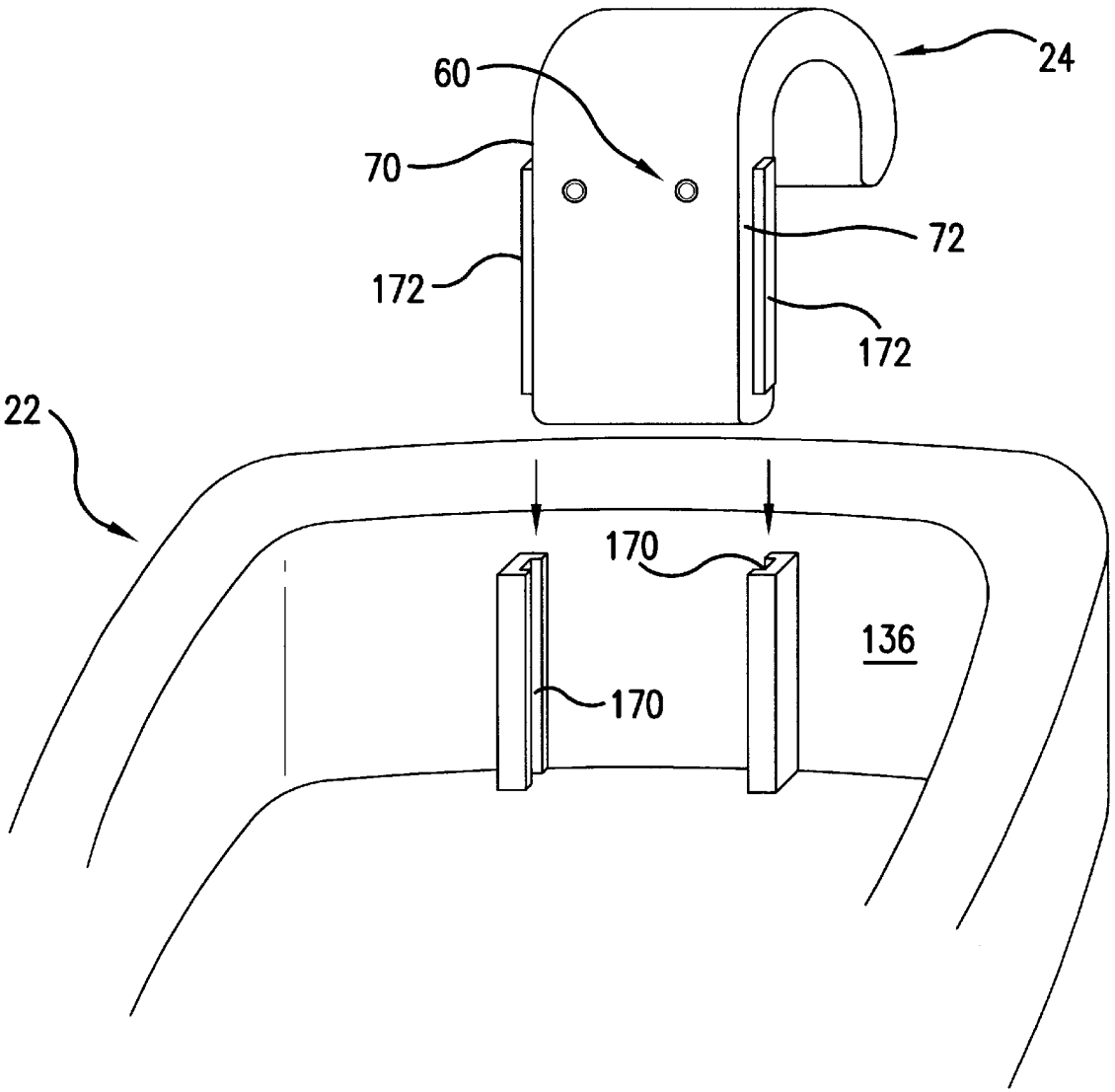

Slide-fit and similar slotted mechanisms can also be used. For example, as shown in FIG. 16, a pair of spaced-apart U-shaped vertical slots 170 can be provided in the pool 22 adjacent the inner wall 136, and ridges 172 can be provided on the side walls 70 and 72 of the jet nozzle unit 24. The ridges 172 are adapted to be slid into the slots 170, and are retained in the slots 170 so that the jet nozzle unit 24 is held between the two slots 170, thereby coupling the jet nozzle unit 24 to the inner wall 136.

Figure 17B:
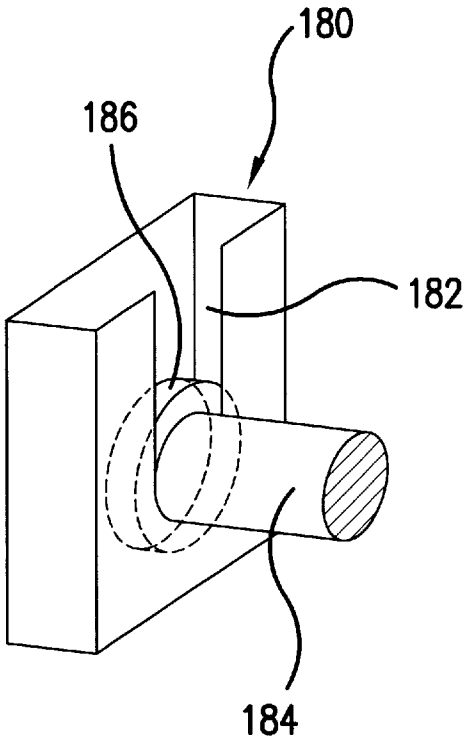
Figure 17A:
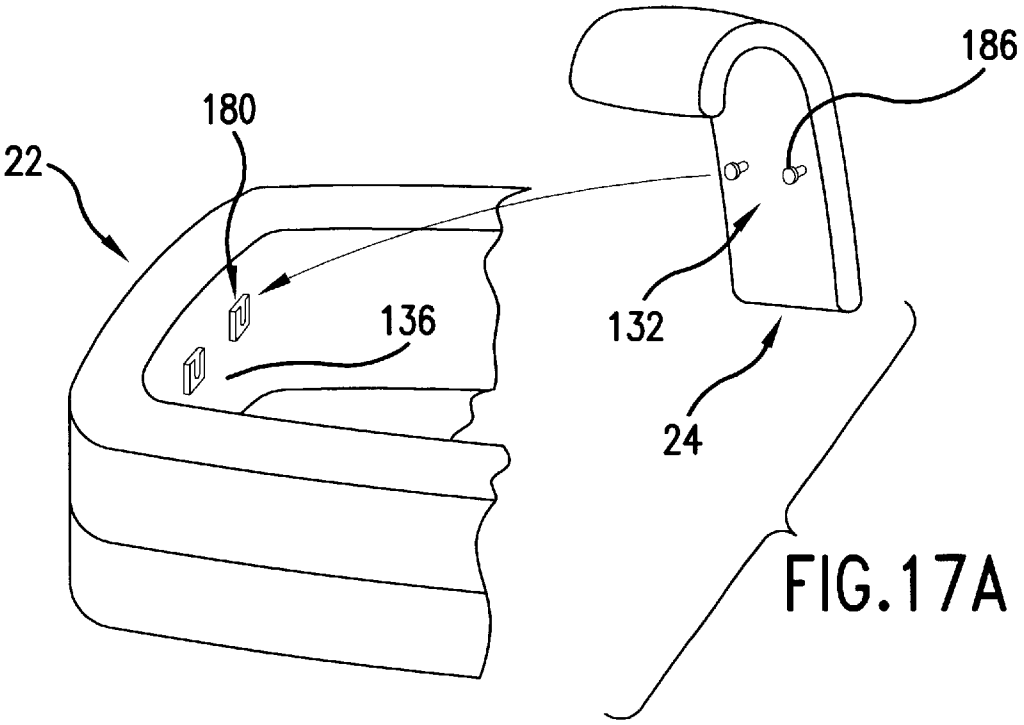

Similarly, FIGS. 17A and 17B illustrate the provision of a pair of pockets 180 secured to the inner wall 136. Each pocket 180 has a vertical groove 182 that is adapted to receive the stem 184 of a bulbous button 186 that is secured to the rear side 132 of the jet nozzle unit 24. As best shown in FIG. 17B, the stem 184 of each button 186 can be slid into the groove 182, with the button 186 being retained inside the pocket 180. Since the button 186 is larger in size than the width of the groove 182, the button 186 can only be removed from the pocket 180 by sliding it upwardly out of the pocket 180, and cannot be pulled out via the groove 182.

Figure 18:
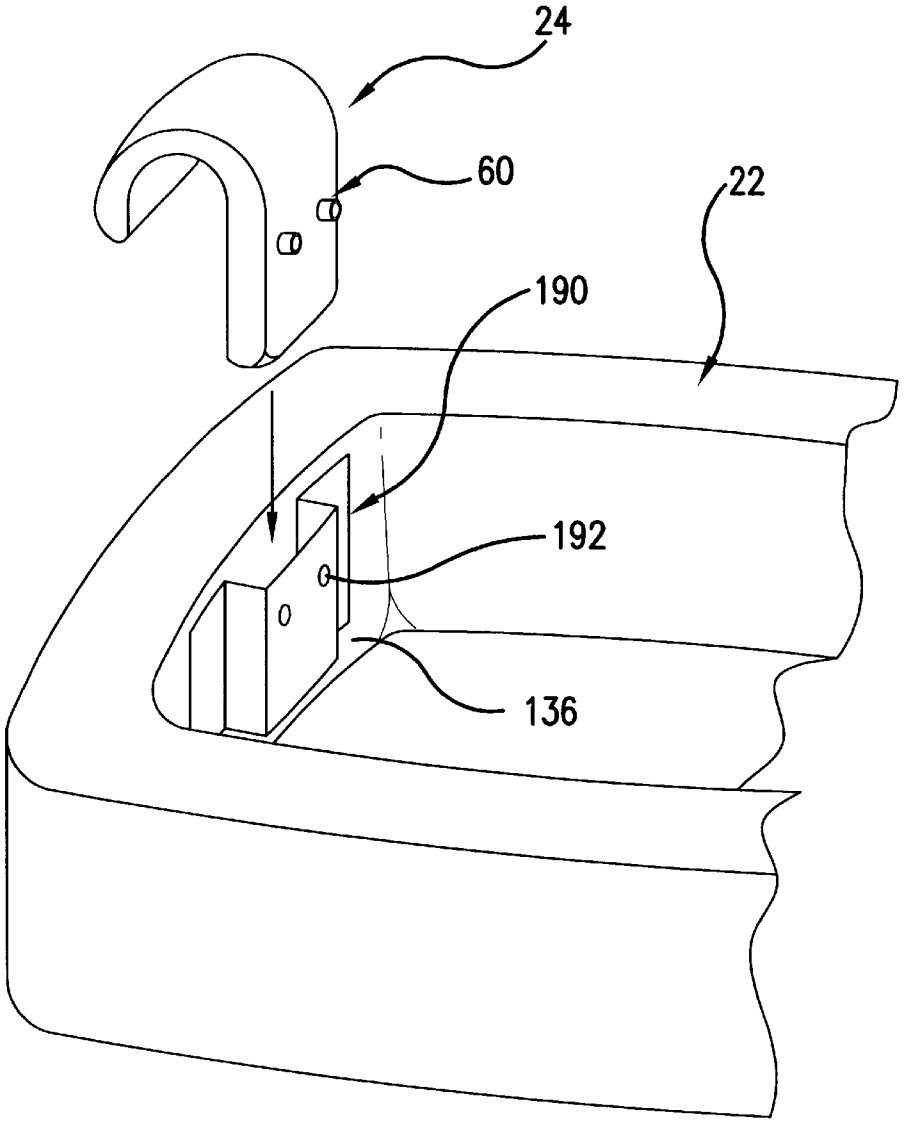

FIG. 18 illustrates a concept that is very similar to that in FIG. 16. Instead of a pair of slots 170, a large slot or envelope 190 can be secured to the inner wall 136, and the entire jet nozzle unit 24 can be received inside the envelope 190. Openings 192 can be provided on the envelope 190 to be aligned with the jet nozzles 60.

Figure 19B:
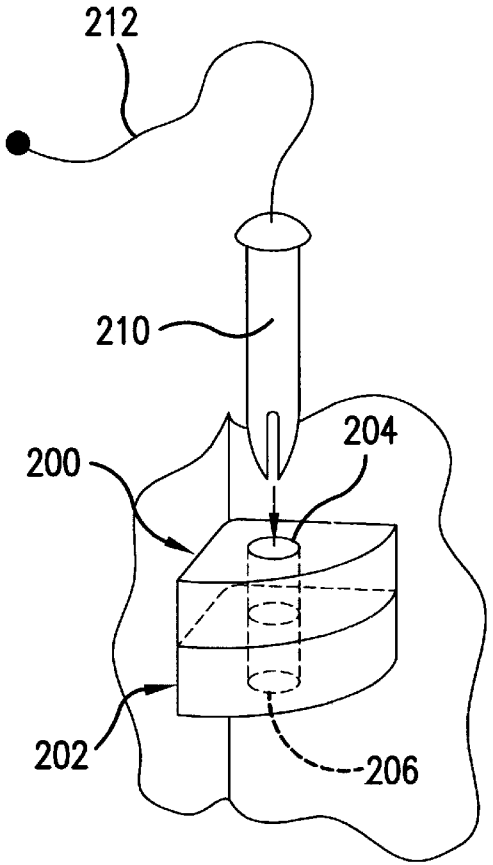
Figure 19A:
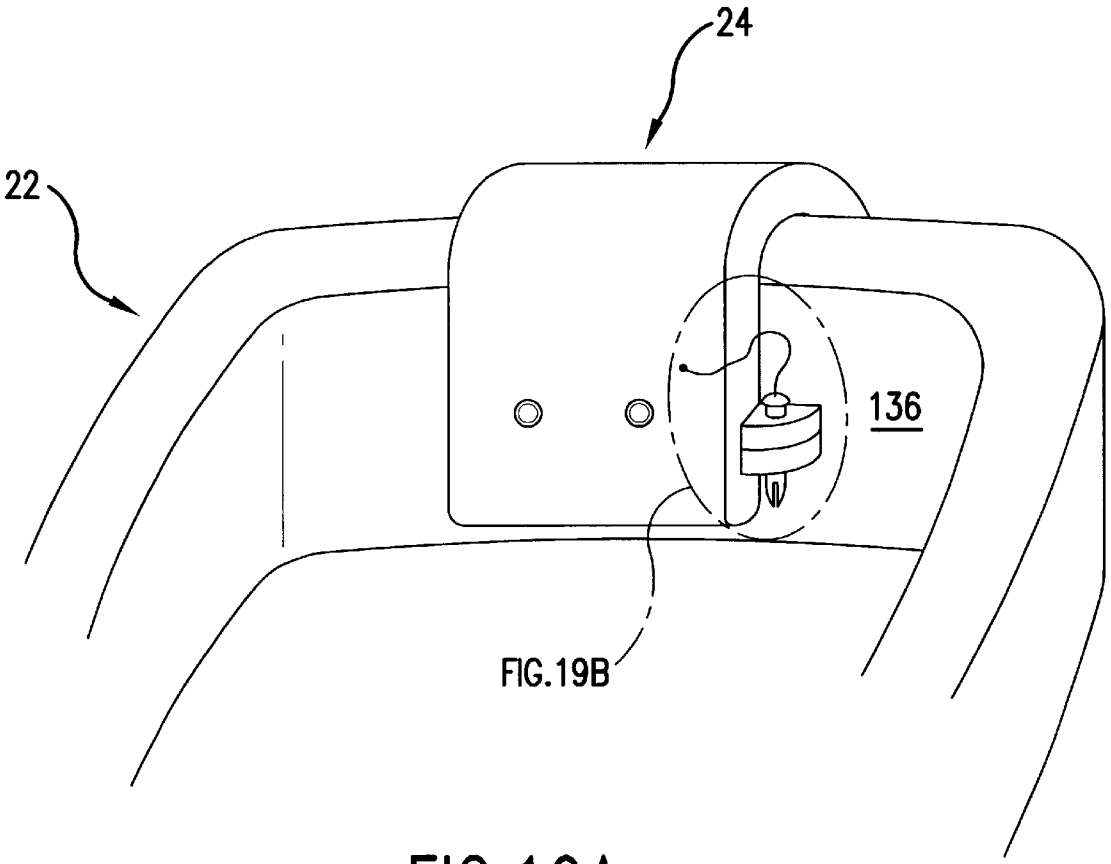
Figure 20:
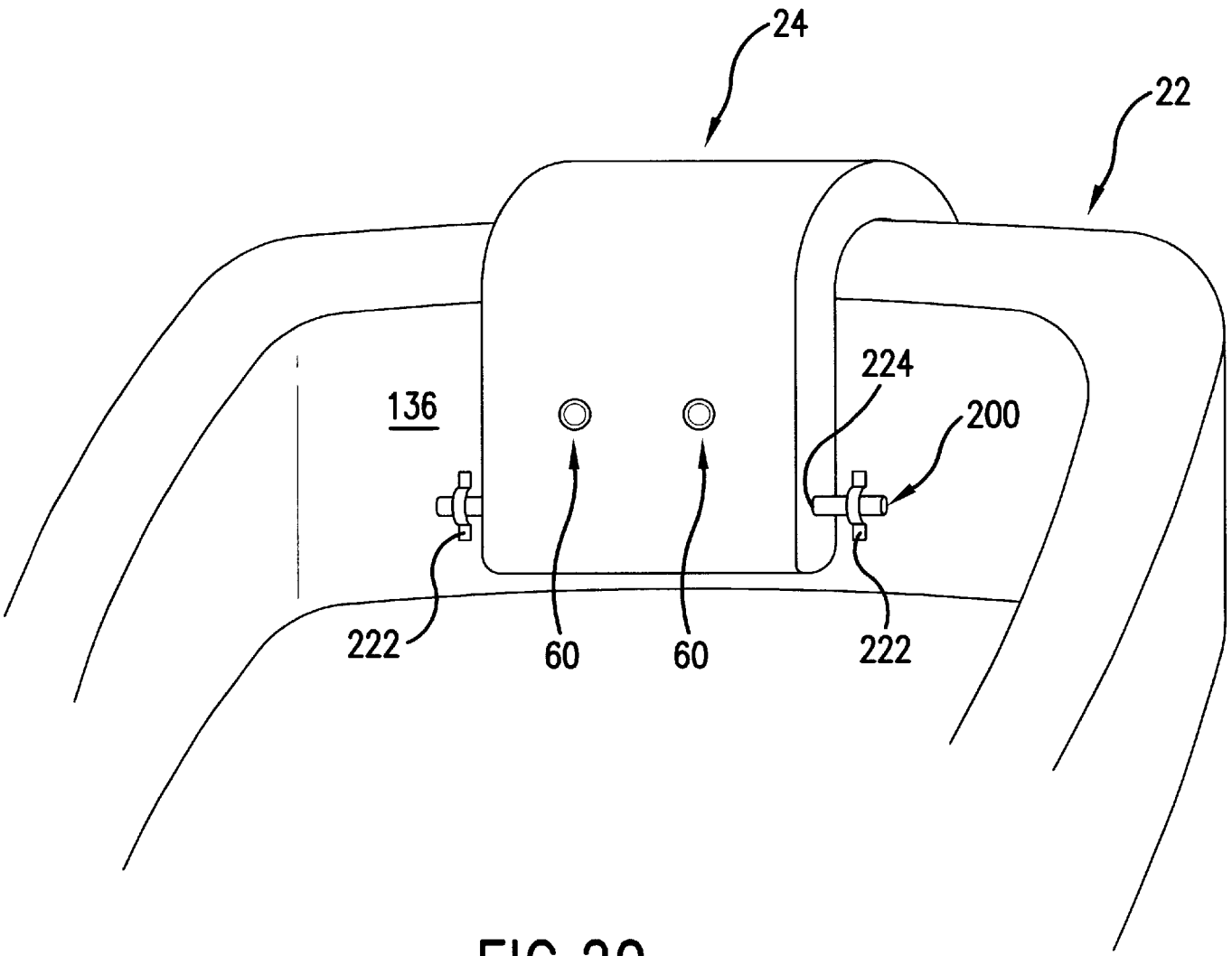

Removable fixtures, bolts and connections can also be used. FIGS. 19A and 19B illustrate a connector mechanism that has a first connector piece 200 secured to the jet nozzle unit 24 and a second connector piece 202 secured to the inner wall 136. Each connector piece 200 and 202 has a through opening 204 and 206, respectively, that are aligned with each other and adapted to receive a split-end locking pin 210. The locking pin 210 can be carried by a string 212 that is permanently secured to either the jet nozzle unit 24 (as shown in FIG. 19B) or the inner wall 136. In use, the two connector pieces 200, 202 are positioned together so that their openings 204, 206 are aligned, and then the locking pin 210 is inserted through the openings 204, 206 to secure the jet nozzle unit 24 to the inner wall 136. To remove the jet nozzle unit 24 from the inner wall 136, the locking pin 210 is removed from the openings 204, 206. Alternatively, the openings 204 and 206 can be provided with inner threads (not shown), and the pin 210 can be a threaded screw, so that the threaded screw can be screwed into the openings to connect the two connector pieces 200, 202 together. As a further example, FIG. 20 illustrates the provision of a shaft 220 that is adapted to extend through a bore or opening 224 in the jet nozzle unit 24 from one side wall 70 through the other side wall 72. Loops 222 are provided on the inner wall 136 on either side of the jet nozzle unit 24. To secure the jet nozzle unit 24 to the inner wall 136, the jet nozzle unit 24 is positioned between the loops 222, and the shaft 220 is extended through the loops 222 and the opening 224.

Figure 21:
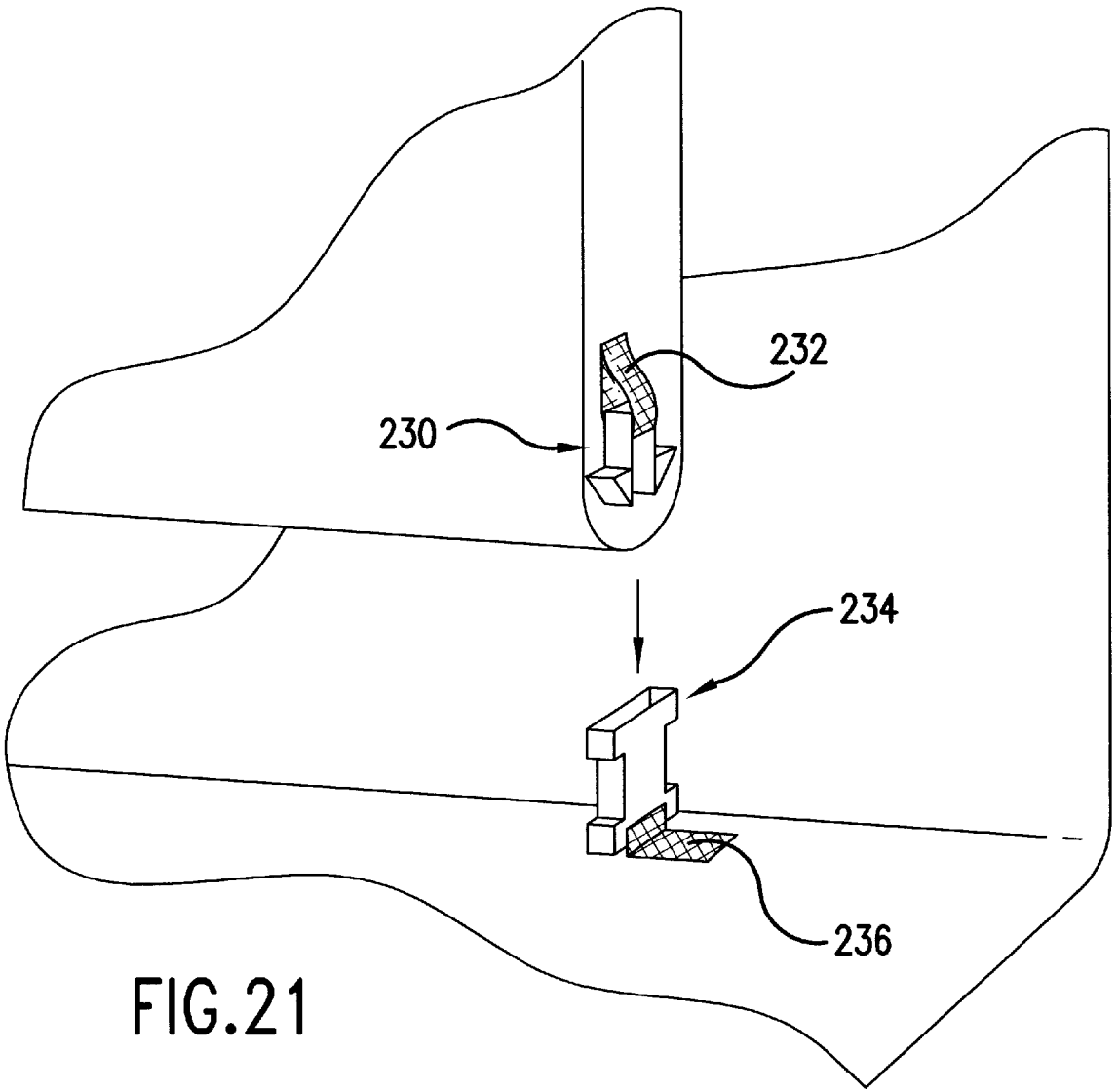

FIG. 21 illustrates yet another possible connection mechanism, which takes the form of a conventional quick-release buckle that is commonly used with baby chairs, seats, backpacks and other items. The male buckle element 230 can be secured via a nylon or PVC webbing 232 to the jet nozzle unit 24, and the female buckle element 234 can be secured via nylon or PVC webbing 236 to the floor chamber 36 of the pool 22.

Figure 22:
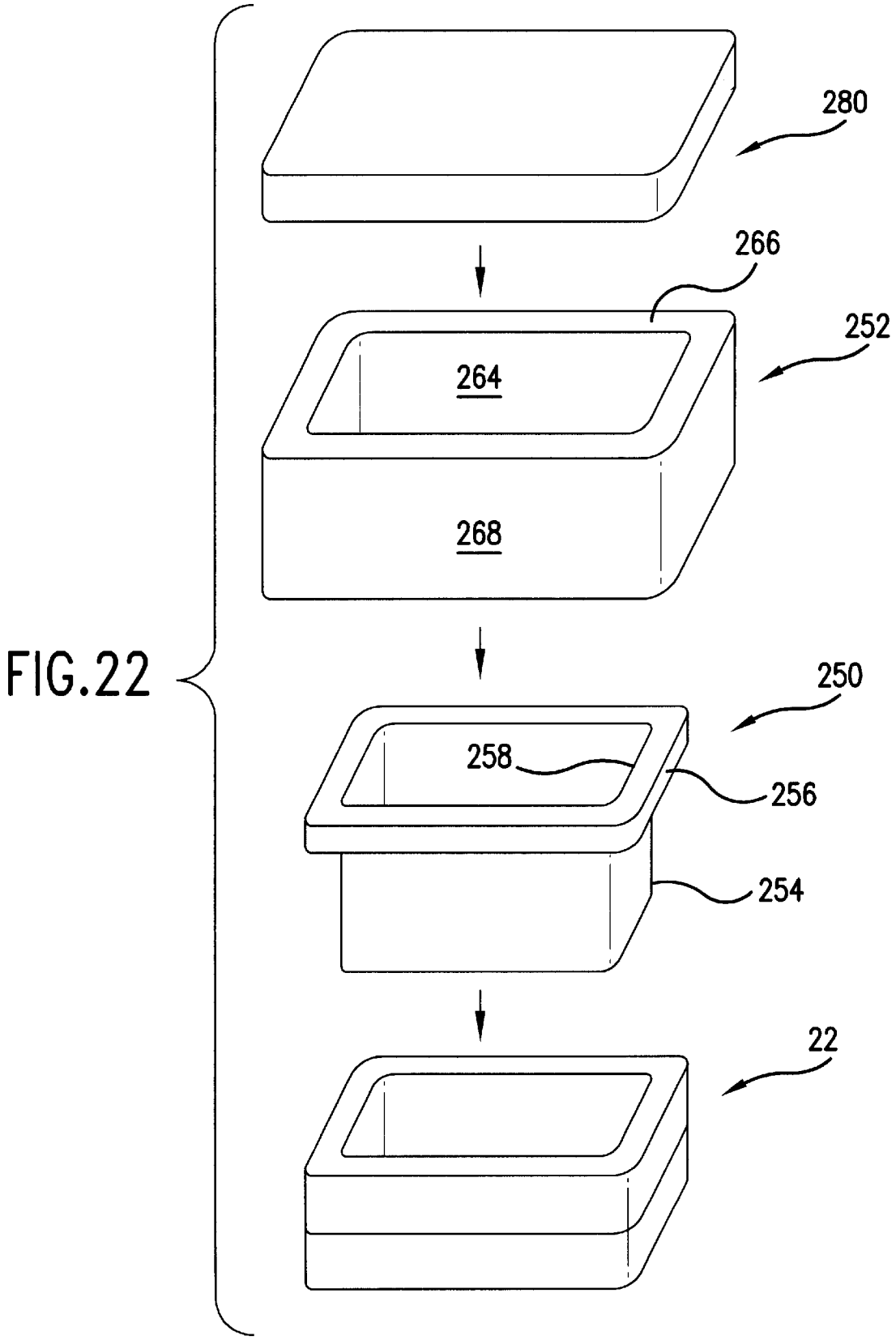
FIG. 22 is an exploded perspective view of the spa pool assembly of FIG. 1.

As shown in FIG. 22, the spa pool assembly 20 can also include a liner 250 and a cover 252. The liner 250 has a container portion 254 that is sized and configured to be placed over the pool 22, and is adapted to receive water. The liner 250 has a fold-over flange or collar 256 provided along the top edge 258 of the container portion 254. The liner 250 is preferably made from a material that is water-impervious and which is capable of tolerating heat and cold. Non-limiting examples of the material can include PVC, rubber, nylon, PU lamination, and polyethylene. The liner 250 also acts as a water-containing layer of material that protects against water leakage, and to protect the pool 22 itself from puncture or other damage. Cold-crack additives (i.e., cold weather proofing) and other additives can be coated or added to the liner 250 to improve the durability of the liner 250.

The cover 252 is sized and configured similarly as the liner 250, and has an inner layer 264 that overlies the container portion 254 of the liner 250, an annular lip portion 266 that overlies the collar 256, and an annular outer layer 268 that overlies the outer periphery of the collar 256 and the pool 22. The cover 252 can perform two functions. First, the surfaces of the layers 264 and 268 can be provided with decorated designs to provide an aesthetically pleasing surface cover to hide the internal components of the portable spa pool assembly 20. Second, the cover 252 can provide an additional layer of protection for the pool 22 itself to prevent puncture or other damage to the pool 22 and the liner 250, and to protect against water leakage. The cover 252 can be made from a material that is waterproof, mold-resistant, washable and which provides a good texture or feel (since the user would be sitting on the cover 252). Non-limiting examples of these materials include a nylon with a polyurethane coating that waterproofs the nylon, or a fabric.

In addition, an outer cover 280 can be provided to completely insulate and cover the interior 31 of the pool 22. For example, the outer cover 280 can prevent heat loss due to air convection when the pool 22 is being heated up for use. The outer cover 280 also serves as a winter or outdoor protective cover, and can be helpful in preventing children from inadvertently falling into the pool 22.

When the spa pool assembly 20 is assembled, the liner 250 and cover 252 are placed over the pool 22, in the manner shown in FIG. 22. The jet nozzle unit 24 can then be placed over the cover 252 and secured using one of the mechanisms described in connection with FIGS. 9–21. Note that the cover 252 and liner 250 must be adapted to accomodate the selected connection mechanism. For example, openings can be provided in the cover 252 and the liner 250 to allow the connection mechanisms to extend therethrough.

Figure 23:
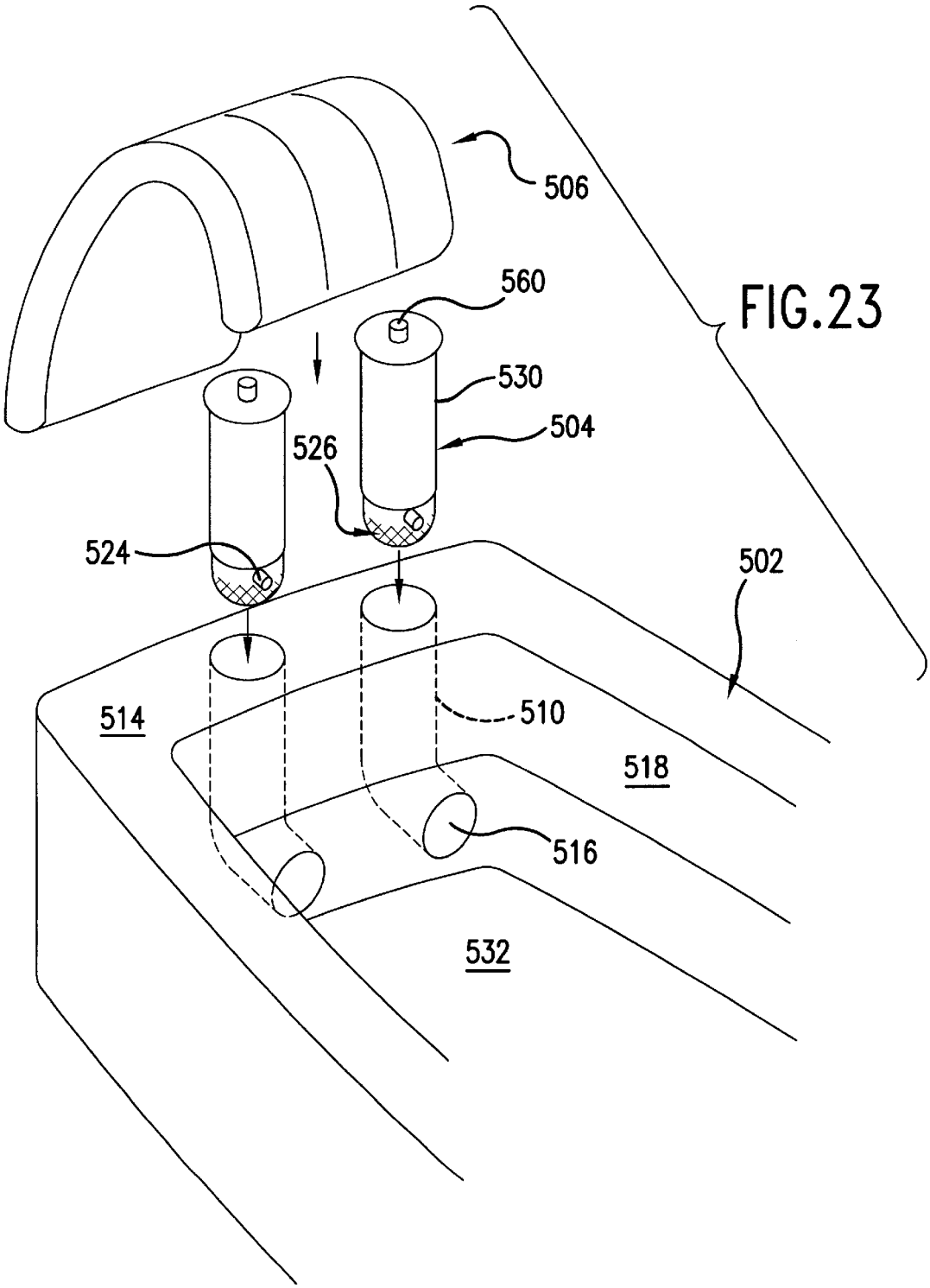
FIG. 23 is an exploded partial perspective view of a portable spa pool according to another embodiment of the present invention.
Figure 24:
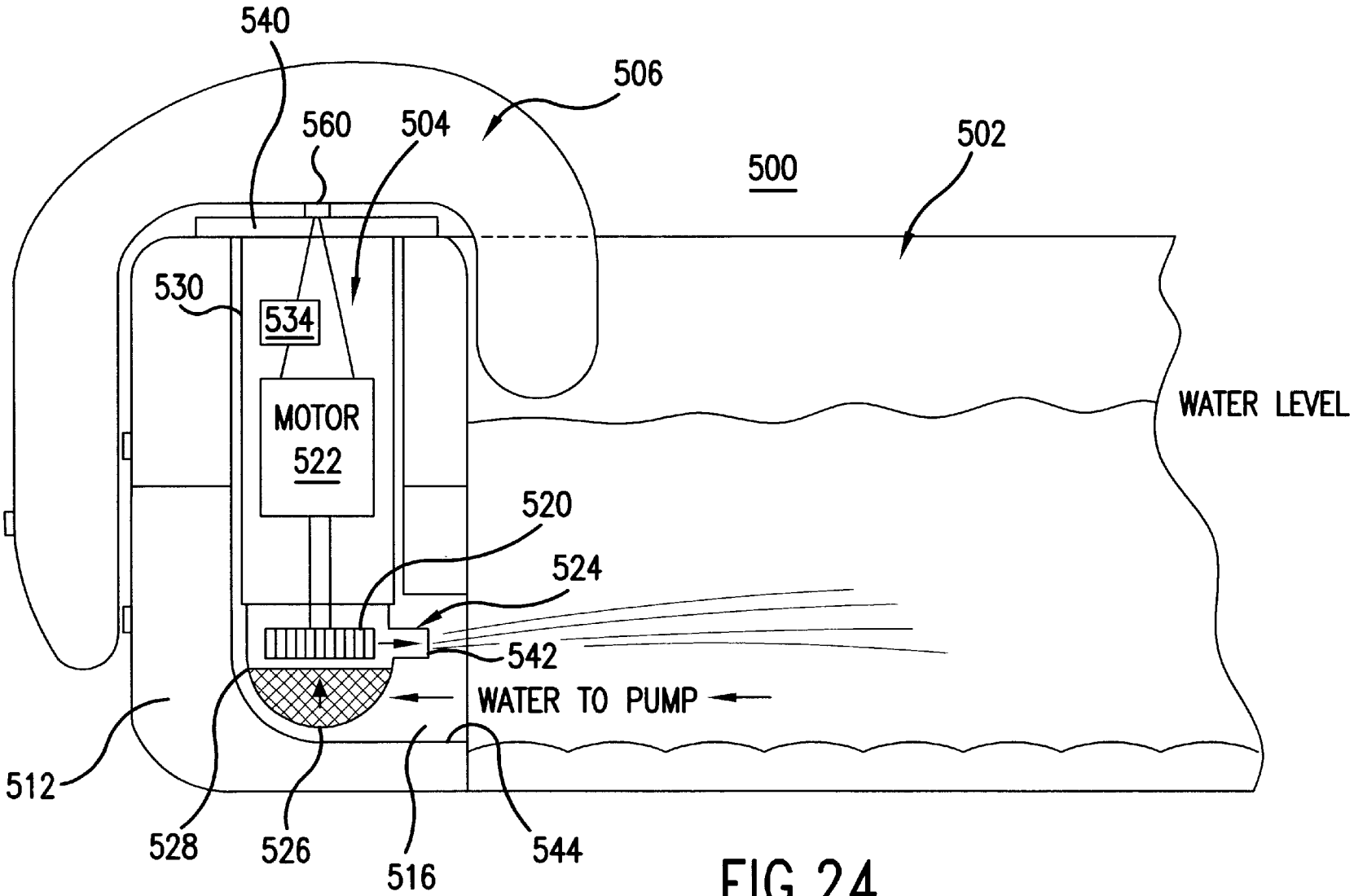
FIG. 24 is a cross-sectional side view of the spa pool of FIG. 23.

FIGS. 23–24 illustrate a portable spa pool assembly 500 according to another embodiment of the present invention. The spa pool assembly 500 has a pool 502, one or more pump units 504, and a pillow 506. Again, the pool 502, pump units 504 and pillow 506 are separate modular components.

The pool 502 is essentially the same in construction and material as the pool 22, except that one or more L-shaped channels 510 are provided inside the wall 512 of the pool 502. Each channel 510 extends vertically from the top surface 514 of the wall 512 and its shorter leg portion 516 extends horizontally therefrom and opens at an opening 544 in the inner surface 518 of the wall 512. Any number of these channels 510 can be provided in spaced-apart manner along the wall 512 of the pool 502 to accomodate a pump unit 504, thereby allowing the user with the flexibility of selecting the locations where the jet nozzles are to be positioned.

Each pump unit 504 is essentially a stand-alone jet nozzle unit and pump. Each pump unit 504 has a housing 530 which houses a pump 520, a motor 522, and a jet nozzle 524. The jet nozzle 524 can be any conventional jet nozzle and similar to the jet nozzle 60 described above. A strainer 526 is provided at the base 528 of the housing 530, which operates as a water inlet through which water from the pool 502 can be drawn. The jet nozzle 524 is positioned slightly above the base 528 and is adapted to be directed at the leg portion 516 of the channel 510. The pump 520 is positioned adjacent the base 528 for drawing water into the water inlet, and for pumping the water back towards the jet nozzle 524 to be ejected back into the interior 532 of the pool 22. The motor 522 is coupled to the pump 520 for driving the pump 520, and a power supply 534 (which can be a battery pack or a wire that leads to an external power supply) is coupled to the motor 522 for powering the motor 522.

The housing 530 can be cylindrical in configuration, although it can be embodied in any configuration. The housing 530 can be made from plastic or non-corrosive metal, and has a cap or lid 540 that seals the interior of the housing 530. A switch 560 can be provided on the lid 540, and coupled to the motor 522 and power supply 534 to turn on the pump unit 504. An opening 542 is provided adjacent the base 528 of the housing 530 for receiving the jet nozzle 524.

The pillow 506 can be any conventional inflatable pillow, or made of foam or other soft material. The pillow 506 is optional in the assembly 500.

In use, the user inserts the pump unit 504 into a desired channel 510 with the jet nozzle 524 facing the leg portion 516 of the channel 510. As shown in FIG. 24, the jet nozzle 524 will be facing the interior 532 of the pool 502, and the strainer 526 will be at the base of the channel 510 adjacent the leg portion 516. The interior 532 of the pool 502 is then filled with water to a level that is preferably higher than the opening 544 in the inner surface 518 of the wall 512. If the pillow 506 is provided, the user attaches it to the pool 502 using removable attachment mechanisms (such as VELCRO™ pads) that are well-known in the art. Usually, the user would position the pillow 506 over the top of the pump unit 504 if the user desires the jet nozzle 524 to be directing water at his or her back. The pump unit 504 is then turned on by turning the switch 560 on, and the pump 520 will draw water from the pool 502 through the leg portion 516 and into the pump unit 504 via the strainer 526. The water is then pumped back via the jet nozzle 524 to the interior 532 of the pool 502. Unlike the assembly 20, the jet nozzles 524 only eject water but no air, so the pump unit 504 is not provided with any air hoses. However, it is possible to provide the pump unit 504 with an air control and air hoses as in assembly 20 so that the jet nozzles 524 would also eject air bubbles.

To disassemble the assembly 500, the user merely turns off the pump unit 504, removes the pillow 506, and then removes the pump unit 504 from the channel 510. The water inside the pool 502 is then emptied. Therefore, as illustrated herein, assembly and disassembly of the spa pool assembly 500 is quick, convenient and simple.

The spa pool assembly 500 shares many of the same benefits as the spa pool assembly 20. Since the plumbing system is completely encompassed inside the modular housing 530 of the pump unit 504, the possibility of leakage from either the plumbing system or the pool 502 is significantly minimized. In addition, it is important to note that the plumbing system (i.e., the pump unit 504) can be installed into or taken out of the pool 502 without deflating the pool 502. Moreover, the modularity of the pool 502 and the pump unit 504 shares the same benefits set forth above for the modularity of the components in the spa pool assembly 20.

While the description above refers to particular embodiments of the present invention, it will be understood that many modifications may be made without departing from the spirit thereof. The accompanying claims are intended to cover such modifications as would fall within the true scope and spirit of the present invention. For example, one of the two openings 66 and 68 can be omitted since only one opening is needed to withdraw water from the pool 22.

What is claimed is:

1. A portable spa pool assembly, comprising:

a pool having an enclosing wall defining an interior, the wall further including a channel provided therein, the channel in fluid communication with the interior; and a pump unit removably received inside the channel, the pump unit including a jet nozzle that is directed at the interior of the pool when the pump unit is received inside the channel;

wherein the enclosing wall has an upper surface and an inner surface, and wherein the channel defines a first opening in the upper surface for removing the pump unit therethrough and a second opening in the inner surface through which water is drawn into the pump unit and also recirculated to the pool interior.

2. The assembly of claim 1, wherein the pump unit further includes a water inlet and a motor.

3. The assembly of claim 1, wherein the pump unit further includes a housing for retaining the jet nozzle.

4. The assembly of claim 1, wherein the channel is L-shaped.

5. A portable spa pool assembly, comprising:

a portable pool having an enclosing wall defining an interior, the wall further including an L-shaped channel provided therein having a first opening in fluid communication with the interior; and a pump unit removably received inside the channel through a second opening in a top surface of the enclosing wall, the pump unit including a jet nozzle that is directed at the interior of the pool when the pump unit is received inside the channel.

6. The assembly of claim 5, wherein the pump unit further includes a water inlet and a motor.

7. The assembly of claim 5, wherein the pump unit further includes a housing for retaining the jet nozzle.

* * * * *